US006884046B2

(12) United States Patent
Matsukawa et al.

(10) Patent No.: US 6,884,046 B2
(45) Date of Patent: Apr. 26, 2005

(54) SCROLL COMPRESSOR

(75) Inventors: Kazuhiko Matsukawa, Sakai (JP); Masanori Yanagisawa, Sakai (JP); Hiroshi Kitaura, Sakai (JP)

(73) Assignee: Daiken Industries, Ltd., Osaka (JP)

( * ) Notice: Subject to any disclaimer, the term of this patent is extended or adjusted under 35 U.S.C. 154(b) by 154 days.

(21) Appl. No.: 10/467,271

(22) PCT Filed: Feb. 27, 2002

(86) PCT No.: PCT/JP03/02282

§ 371 (c)(1),
(2), (4) Date: Aug. 6, 2003

(87) PCT Pub. No.: WO03/074879

PCT Pub. Date: Sep. 12, 2003

(65) Prior Publication Data

US 2004/0062670 A1 Apr. 1, 2004

(30) Foreign Application Priority Data

Mar. 29, 2002 (JP) ..... 2002-094199

(51) Int. Cl.[7] ..... F01C 18/00
(52) U.S. Cl. ..... 418/55.1; 417/902
(58) Field of Search ..... 418/55.1; 417/902

(56) References Cited

U.S. PATENT DOCUMENTS 3,285,504 A * 11/1966 Smith ..... 417/902
6,193,485 B1 * 2/2001 Ueda et al. ..... 418/55.1

FOREIGN PATENT DOCUMENTS

| | | | | |
|---|---|---|---|---|
| EP | 0756088 | | 1/1997 | |
| EP | 0926344 | | 6/1999 | |
| JP | 63151431 | A * | 6/1988 | ..... B29C/65/02 |
| JP | 04132890 | A * | 5/1992 | ..... F04C/18/02 |
| JP | 05209591 | A * | 8/1993 | ..... F04C/18/02 |
| JP | 06026468 | A * | 2/1994 | ..... F04C/18/02 |
| JP | 06272677 | A * | 9/1994 | ..... F04C/18/02 |
| JP | 7-158577 | | 6/1995 | |

* cited by examiner

*Primary Examiner*—Theresa Trieu
(74) *Attorney, Agent, or Firm*—Shinjyu Global IP Counselors, LLP

(57) ABSTRACT

In a rotating compressor, an outer peripheral surface of a partition member which is secured firmly to a casing so as to divide the inside of the casing into a high-level pressure space and a low-level pressure space, is provided with a peripheral groove for allowing for shrinkage of the casing at a weld area where a trunk part and end plate of the casing are welded together. As a result of such arrangement, the partition member is strongly tightened by making utilization of such shrinkage, thereby not only enhancing sealability between the high-level pressure space and the low-level pressure space in the inside of the casing but also preventing a drop in workability during assembling and an increase in cost.

8 Claims, 7 Drawing Sheets

(a)

(b)

SCROLL COMPRESSOR

TECHNICAL FIELD

The present invention relates generally to a rotating compressor and, more particularly, pertains to a seal construction between a high-level pressure space and a low-level pressure space in the inside of a rotating compressor casing.

BACKGROUND ART

Various types of compression mechanisms such as scroll type, swing type, and rolling piston type (i.e., rotary type) have been employed in conventional rotating compressors. Such a rotating compressor is used to compress a refrigerant gas in a refrigerating apparatus (e.g., an airconditioner) which executes a refrigerating cycle, as set forth for example in Japanese Patent Kokai No. (2000)97183. A compressor motor, housed in the rotating compressor, serves as a drive source for activating a compression mechanism of the scroll, swing, or rolling piston type.

Here, referring to a scroll compressor (100) of FIG. 10 as an example, a general structure of a conventional rotating compressor will be described below.

The scroll compressor (100) is made up of a casing (101), a compressor motor (102), and a compression mechanism (103). The casing (101) is made up of a trunk part (104) shaped like a cylinder and end plates (105, 106) secured firmly, by welding, to an upper and lower ends of the trunk part (104), respectively. The compressor motor (102) is made up of a stator (107) secured firmly to the trunk part (104) and a rotor (108) disposed on the inner peripheral side of the stator (107). A drive shaft (109) is coupled to the rotor (108).

The compression mechanism (103) has a fixed scroll, an orbiting scroll, and a housing all of which are not shown in the Figure, and the housing is secured firmly to the casing. In some cases, the fixed scroll is secured firmly to the casing. Additionally, the drive shaft (109) projects above and below the stator (107) and the rotor (108). An upper end of the drive shaft (109) is connected to the orbiting scroll. On the other hand, a lower end of the drive shaft (109) is supported, through a bearing member (110), on the casing (101). Operations of the orbiting scroll accompanying the rotation of the drive shaft (109) cause variations in volume of a compression chamber, whereby the compression mechanism (103) performs operations of sucking, compressing, and discharging a refrigerant gas.

In the scroll compressor (100), the housing of the compression mechanism (103) is close-fitted, at its outer peripheral part, to the casing (101), thereby defining spaces separated from each other, i.e., a space above the compression mechanism (103) and another below the compression mechanism (103), as set forth for example in Japanese Patent Kokai No. (1999)22661. In the example diagrammed, the lower space is a high-level pressure space, while the upper space is a low-level pressure space. These spaces are sealed off from each other at a joint area (111) between the casing (101) and the housing. In such an arrangement, the housing functions as a partition member.

PROBLEMS THAT INVENTION INTENDS TO SOLVE

In the conventional scroll compressor, generally the housing is secured firmly to the casing by thermal insert.

Although thermal insert provides a structure of high sealability, it suffers problems with workability during the time that products are being assembled.

By contrast to the above, there may be an alternative structure in which the housing is secured firmly to the casing only by press fitting. In this case, workability is improved in comparison with a structure of the thermal insert type; however, there is the possibility that sealability decreases and, as a result, refrigerant leaks from the high-level pressure space to the low-level pressure space. Use of a special seal member for enhancing sealability results in increasing the costs.

Bearing in mind these problems, the present invention was made. Accordingly, an object of the present invention is to enhance not only workability during compressor assembling but also sealability between a high-level pressure space and a low-level pressure space in a casing in a rotating compressor, and to prevent the increase in costs.

DISCLOSURE OF INVENTION

In the present invention, a peripheral groove (42) for allowing for shrinkage of a casing (10) at a weld area where a trunk part (11) of the casing (10) and an end plate (12) are welded together, is formed in an outer peripheral surface (40) of a partition member (23) dividing the inside of the casing (10) into a high-level pressure space and a low-level pressure space, and the partition member (23) is tightened by making utilization of such shrinkage.

More specifically, a first aspect of the present invention is directed to a rotating compressor comprising a casing (10) housing therein: a compressor motor (30), a compression mechanism (20) which is driven by the compressor motor (30), and a partition member (23) which divides the inside of the casing (10) into a high-level pressure space and a low-level pressure space, the casing (10) having a trunk part (11) shaped like a cylinder and an end plate (12) secured firmly to the trunk part (11) by welding.

The rotating compressor is characterized in that the partition member (23) is so formed as to be press-fitted to the casing (10) at a weld area where the trunk part (11) and the end plate (12) are welded together or in the vicinity of the weld area, and a peripheral groove (42) extending continuously in a circumferential direction for allowing for shrinkage of the casing (10) caused by welding at the weld area of the trunk part (11) and the end plate (12) is formed in an outer peripheral surface (40) of the partition member (23).

The "partition member (23)" of this structure may be a member to which a fixed scroll is attached or a fixed scroll itself for the case of a scroll compressor. The partition member (23) may be any member as long as it divides the inside of a casing into a high-level pressure space and a low-level pressure space, even for the case of a rotary or swing compressor.

In the invention as set forth in the first aspect, when the trunk part (11) and the end plate (12) are welded together with the partition member (23) close-fitted, by press fitting, to the casing (10) (either the trunk part (11) or the end plate (12)), the welding of the trunk part (11) and the end plate (12) causes the casing (10) to shrink at the peripheral groove (42) of the outer peripheral surface (40) of the partition member (23). Prior to welding, the partition member (23) is merely press-fitted to the casing (10); however, the act of welding causes the casing (10) to strongly tighten the partition member (23) in the vicinity of the peripheral groove (42), thereby making it possible to provide sealability of the same level that thermal insert provides.

A second aspect of the present invention according to the rotating compressor of the first aspect is characterized in that a projection part (45)(46, 47) extending continuously in a circumferential direction at a position in proximity to the peripheral groove (42) is formed in the outer peripheral surface (40) of the partition member (23), and that the projection part (45)(46, 47) is so formed as to be press-fitted to the casing (10).

In such arrangement, the trunk part (11) and the end plate (12) are welded together, with the projection part (45)(46, 47) formed in the outer peripheral surface (40) of the partition member (23) press-fitted to the casing (10) (either the trunk part (11) or the end plate (12)), thereby producing the same action as obtained by further increasing the margin for press-fitting of the projection part (45)(46, 47) to the trunk part (11) or to the end plate (12), and the sealability is improved.

In a third aspect of the present invention, the outer peripheral surface (40) of the partition member (23) is clearance-fitted to the trunk part (11) or end plate (12) of the casing (10), and the peripheral groove (42) and the projection part (45)(46, 47) are formed in the outer peripheral surface (40) of the partition member (23).

In other words, this invention is characterized in that the partition member (23) is so formed as to be clearance-fitted to the casing (10) at a weld area where the trunk part (11) and the end plate (12) are welded together or in the vicinity of the weld area, that the peripheral groove (42) extending continuously in circumferential direction for allowing for shrinkage of the casing (10) caused by welding at the weld area of the trunk part (11) and the end plate (12), and the projection part (45)(46, 47) extending continuously in circumferential direction at a position in proximity to the peripheral groove (42) are formed in the outer peripheral surface (40) of the partition member (23), and that the projection part (45)(46, 47) is so formed as to be press-fitted to the casing (10).

In the invention as set forth in the third aspect, when the trunk part (11) and the end plate (12) are welded together, with the partition member (23) press-fitted to the trunk part (11) or end plate (12) of the casing (10) only at the projection part (45)(46, 47), the casing (10) shrinks at the position of the peripheral groove (42) and its tightening force becomes greater. Accordingly, this structure also provides sealability of the same level that thermal insert achieves.

Further, a fourth aspect of the present invention according to the rotating compressor of either the second aspect or the third aspect is characterized in that the projection part (46,47) of the partition member (23) is provided at a plurality of areas.

In such an arrangement, the projection part (46, 47) extending continuously in a circumferential direction in the outer peripheral surface (40) of the partition member (23) is provided in multiple in the axial direction of the partition member (23), thereby providing an enhanced sealability because the number of points where the projection part (46, 47) is press-fitted to the trunk part (11) or to the end plate (12) increases.

A fifth aspect of the present invention according to the rotating compressor of the fourth aspect is characterized in that the projection parts (46, 47) differ in projection height from each other.

In such an arrangement, for example, it becomes possible to make the projection height of a projection part (46, 47) on the forward side relative to the direction of press-fitting the partition member (23) to the trunk part (11) or to the end plate (12) shorter than the projection height of a projection part (46, 47) on the rearward side relative to the press-fitting direction. This makes it possible to press-fit the partition member (23) to the casing (10) with relative ease and, in addition, there is no drop in sealability.

Further, a sixth aspect of the present invention according to the rotating compressor of either the second aspect or the third aspect is characterized in that one end or both ends **(45*a*, 45*b*) of the projection part (45)(46, 47) relative to the axial direction of the partition member (23)** are formed into a tapered surface.

In the invention of the sixth aspect, if, of the ends of the projection part (45)(46, 47), a forward side end relative to the direction of press-fitting the partition member (23) to the trunk part (11) or to the end plate (12) is formed into a tapered surface **(45*a*), press-fitting of the partition member (23) to the casing (10) becomes easy to carry out. In addition, if, of the ends of the projection part (45)(46, 47), a rearward side end relative to the press-fitting direction is formed into a tapered surface (45*b*), this makes it easier, when the casing (10) shrinks along the tapered surface (45*b*) at a weld area where the trunk part (11) and the end plait (12) are welded together, for such a shrinking area of the casing (10) to come into press-contact with the tapered surface (45*b*). If press-contacting of the projection part (45)(46, 47) with the casing (10)** is insufficient, there is the possibility that the sealability drops. By contrast to this, in the invention of the sixth aspect, it is possible to provide a sufficient press-contacting surface, thereby improving the sealability.

A seventh aspect of the present invention according to the rotating compressor of either the second aspect or the third aspect is characterized in that the partition member (23) has a thick and thin parts (43) and (44) of different thicknesses relative to a radial direction, and that the projection part (45)(46, 47) is formed on an outer periphery of the thick part (43). In this arrangement, the thick part (43) is a part whose radial dimension is thick throughout, while the thin part (44) is a part which partially includes at least a thin subpart.

Although the casing (10) strongly tightens the partition member (23) at the time when it shrinks because of welding, the formation of the projection part (45)(46, 47) on the outer periphery of the thick part (43) of the partition member (23) makes it possible to oppose such a tightening force with the rigidity of the thick part (43). Consequently, it is possible to prevent the partition member (23) from undergoing deformation or the like.

An eighth aspect of the present invention according to the rotating compressor of any one of the first to third aspects is characterized in that the end plate (12) of the casing (10) comes into axial abutment against the trunk part (11) or the partition member (23) and is so formed as to be clearance-fitted to the trunk part (11) or the partition member (23).

With such an arrangement, the partition member (23) is secured firmly to the casing (10) with ease and without fail by welding together the end plate (12) and the trunk part (11) while easily positioning the end plate (12) to the casing (10) in its axial direction.

An A ninth aspect of the present invention according to the rotating compressor of any one of the first to third aspects is characterized in that the compression mechanism (20) is composed of a scroll type compression mechanism (20), and that the partition member (23) is such formed that a fixed scroll (21) is secured firmly to the partition member (23).

By contrast to the above, when the fixed scroll (21) itself is firmly secured, by thermal insert or the like, to the casing (10) so as to serve as the partition member (23) in the scroll compressor, there is the possibility that the fixed scroll (21) undergoes deformation and the performance of the compressor drops, depending on the relationship between the strength of the fixed scroll (21) and the tightening force. However, in the present invention it is arranged such that the partition member (23) formed as a separate body from the fixed scroll (21) is secured firmly to the casing (10). As a result of such arrangement, no tightening force acts on an involute part of the fixed scroll (21) and there occurs no compressor performance decrement.

Effects

In accordance with the invention as set forth in the first aspect, the outer peripheral surface (40) of the partition member (23) which is brought into close-fit with the trunk part (11) or end plate (12) of the casing (10) is provided with the peripheral groove (42) for enabling the casing (10) to shrink by welding at a weld area of the trunk part (11) and the end plate (12), thereby making it possible to strongly tighten the partition member (23) by utilizing such shrinkage. This provides enhanced sealability at the joint area of the casing (10) and the partition member (23). Accordingly, even for the case where the partition member (23) is merely press-fitted to the casing (10), it is possible to obtain sealability of the same level that thermal insert provides after welding was carried out. Besides, since thermal insert is actually unnecessary, this provides an excellent workability during assembling. Further, in such an arrangement that the trunk part (11) and the end plate (12) are welded together after the partition member (23) is thermal-inserted to the trunk part (11), there is the possibility that component parts undergo distortion due to repeated heating. However, in the present invention heating is carried out only once, so that the possibility of distortion of component parts is slim.

Furthermore, conventional compressors employ an O-ring in some cases for obtaining enhanced sealability. In such a case, the costs increases. However, in the aforesaid arrangement, there is no need for the provision of a special seal member such as an O-ring, thereby avoiding the increase in costs due to the increase in the number of component parts.

Further, in accordance with the invention as set forth in the second aspect, the projection part (45)(46, 47) in close proximity to the peripheral groove (42) is formed in the outer peripheral surface (40) of the partition member (23) and the projection part (45)(46, 47) is press-fitted to the trunk part (11) or end plate (12) of the casing (10), whereby sealability is further enhanced by the effect of shrinkage of the trunk part (11).

Further, in accordance with the invention as set forth in the third aspect, the outer peripheral surface (40) of the partition member (23) is clearance-fitted to the trunk part (11) or end plate (12) of the casing (10), wherein the peripheral groove (42) and the projection part (45)(46, 47) are formed in the outer peripheral surface (40) of the partition member (23). Because of such arrangement, it will suffice if only the projection part (45)(46, 47) is press-fitted to the casing (10), thereby facilitating assembling work. In addition, since the casing (10) strongly tightens only the projection part (45)(46, 47), this avoids application of a strong tightening force to the whole of the partition member (23). Accordingly, deformation of the partition member (23) is also prevented. Furthermore, sealability is improved and the increase in costs due to the increase in the number of component parts is prevented, as in the inventions of the first and second aspects.

Further, in accordance with the invention as set forth in the fourth aspect, the projection part (46, 47) extending continuously in a circumferential direction in the outer peripheral surface (40) of the partition member (23) is provided at a plurality of areas, for obtaining a multiple seal effect in axial direction. This provides a further enhanced sealability.

Furthermore, in accordance with the invention as set forth in the fifth aspect, it is arranged such that the projection parts (46, 47) differ in projection height from each other. For example, it becomes possible to make the projection height of one of the projection parts (46, 47) on the forward side relative to the direction of press-fitting the partition member (23) to the casing (10) shorter than the projection height of the other of the projection parts (46, 47) on the rearward side relative to the press-fitting direction. This makes it possible to close-fit the partition member (23) to the casing (10) with relative ease. In other words, workability is enhanced to a further extent without a drop in sealability.

Further, in accordance with the invention as set forth in the sixth aspect, it is arranged such that one end or both ends (45*a*, 45*b*) of the projection part (45)(46, 47) relative to the axial direction of the partition member (23) are formed into a tapered surface. Of the ends of the projection part (45) (46, 47), one end on the forward side relative to the direction of press-fitting the partition member (23) to the casing (10) is formed into the tapered surface (45*a*). This facilitates insertion and enhances workability. Conversely, if the other end of the projection part (45)(46, 47) on the rearward side relative to the press-fitting direction is formed into the tapered surface (45*b*), the trunk part (11) comes into press contact with the tapered surface. Accordingly, it is possible to obtain an adequate sealability.

Furthermore, in accordance with the invention as set forth in the seventh aspect, the partition member (23) has the thick and thin parts (43) and (44) of different thicknesses in a radial direction, wherein the projection part (45)(46, 47) is formed on the outer periphery of the thick part (43) of high rigidity. As a result of such arrangement, even when the trunk part (11) shrinks because of welding, deformation of the partition member (23) is prevented. Accordingly, for example, even when the fixed scroll (21) as a partition member is secured firmly to the casing (10) in the scroll compressor, it is possible to prevent performance decrement of the compressor caused by deformation of the fixed scroll (21).

Further, in accordance with the invention as set forth in the eighth aspect, the end plate (12) of the casing (10) comes into axial abutment against the trunk part (11) or the partition member (23) of the compression mechanism (20) and is so formed as to be clearance-fitted to the trunk part (11) or to the partition member (23). Accordingly, the partition member (23) is secured firmly to the casing (10) without fail by welding together the end plate (12) and the trunk part (11) while easily positioning the end plate (12) to the casing (10), thereby improving workability.

In accordance with the invention as set forth in the ninth aspect, in the scroll compressor the member to which the fixed scroll is secured firmly is the partition member (23), and the partition member (23) is tightened by making utilization of shrinkage caused by welding of the trunk part (11) and the end plate (12). Accordingly, since such a tightening force will not act directly on the fixed scroll, this prevents performance decrement by leakage loss due to involute wrap deformation. It is conceivable that an elastic member capable of absorbing deformation of the partition member (23) is interposed between the fixed scroll and the casing (10) in a conventional structure for suppressing leakage loss. In such a case, however, the number of component parts increases, and there is a drop in assembling property and the costs increases. The present invention is free from such problems.

BEST MODE FOR CARRYING OUT INVENTION

First Embodiment

Hereinafter, a first embodiment of the present invention will be described in detail with reference to the drawings.

The present embodiment is directed to a scroll compressor. In the first place, the entire arrangement of the scroll compressor of the first embodiment will be described with reference to FIG. 1.

Figure 1:
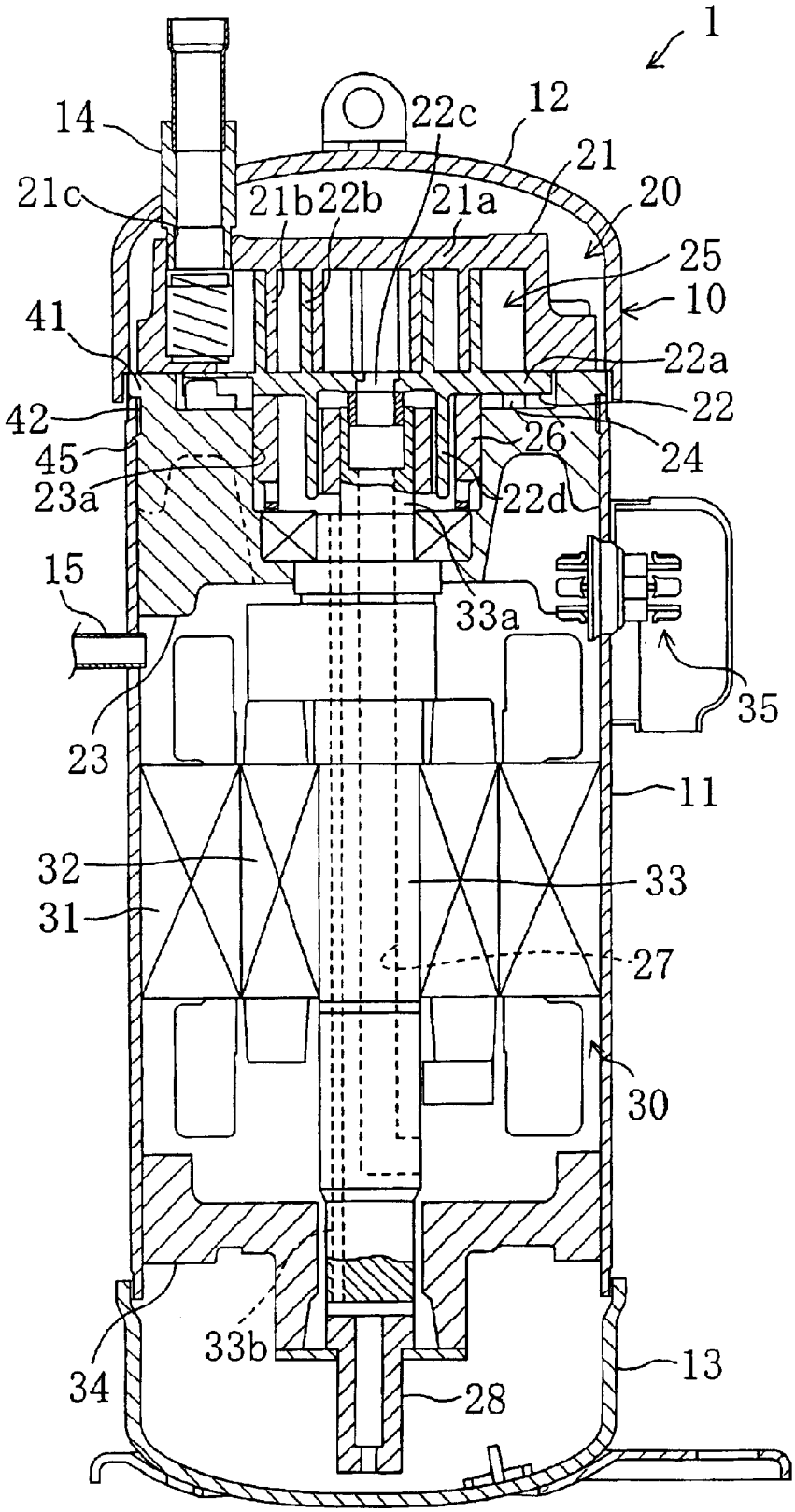
FIG. 1 is a view illustrating in cross section a construction of a scroll compressor according to a first embodiment of the present invention.

The scroll compressor (1) of the first embodiment is used to compress a low-level pressure refrigerant drawn in from the side of an evaporator and discharge it to the side of a condenser in a refrigerant circuit of an airconditioner or other device which performs a vapor compression refrigerating cycle. As shown in FIG. 1, the scroll compressor (1) comprises a casing (10) housing therein a compression mechanism (20) and a compressor motor (30) which is a drive mechanism operable to activate the compression mechanism (20). The compression mechanism (20) is disposed at an upper portion of the inside of the casing (10), while the compressor motor (30) is disposed at a position slightly below the center of the inside of the casing (10). Additionally, the casing (10) is provided with a connector terminal (35) for supplying electric power to the compressor motor (30).

The casing (10) is made up of a trunk part (11) shaped like a cylinder and dish-shaped end plates (12, 13) secured firmly to an upper and lower ends of the trunk part (11) or to their vicinities respectively by welding. A suction pipe (14) is so disposed as to pass through the upper end plate (12) of the casing (10). A discharge pipe (15) passing through the trunk part (11) is disposed at a position slightly above the center of the trunk part (11) so that it communicates with both the inside and the outside of the casing (10). Additionally, it is arranged such that a given amount of lubricant (refrigerating machine oil) (not shown) is stored at the bottom of the casing (10).

The compressor motor (30) is made up of a stator (31) secured firmly to the trunk part (11) of the casing (10) and a rotor (32) disposed on the inner side of the stator (31), and a drive shaft (33) is secured firmly to the rotor (32) of the motor (30). The drive shaft (33) projects vertically relative to the stator (31) and the rotor (32) of the compressor motor (30). An upper end of the drive shaft (33) is connected to the compression mechanism (20), while a lower end thereof is rotatably supported on a bearing member (34) secured firmly to the lower end of the trunk part (11) of the casing (10).

On the other hand, the compression mechanism (20) comprises a fixed scroll (21), an orbiting scroll (22), and a housing (23). The fixed scroll (21) is made up of an end plate **(21*a*) and an involute wrap (21*b*) formed in a lower surface of the end plate (21*a*). The orbiting scroll (22) is made up of an end plate (22*a*) and an involute wrap (22*b*) formed in an upper surface of the end plate (22*a*)**.

The housing (23) constitutes a part of the compression mechanism (20), and the position of the compression mechanism (20) is fixed by firmly securing the housing (23) to the casing (10) by press fitting. The housing (23) is a partition member dividing the internal space of the casing (10) into an upper space and a lower space. More specifically, a low-level pressure space is defined above the housing (23) and a high-level pressure space is defined below the housing (23).

The fixed scroll (21) is fastened firmly to an upper surface of the housing (23) by a fastening means such as a bolt (not shown). The orbiting scroll (22) is disposed between the fixed scroll (21) and the housing (23). Additionally, a rotation preventing member (24) such as an Oldham joint is disposed between the end plate **(22*a*) of the orbiting scroll (22) and the housing (23) so that the orbiting scroll (22) executes only an orbital motion relative to the fixed scroll (21)**.

The wrap **(21*b*) of the fixed scroll (21) and the wrap (22*b*) of the orbiting scroll (22) matingly engage with each other. Between the end plate (21*a*) of the fixed scroll (21) and the end plate (22*a*) of the orbiting scroll (22), a space between contacting parts of the wraps (21*b*, 22*b*) is formed as a compression chamber (25). The compression chamber (25) is so structured as to compress refrigerant as the volume between the wraps (21*b*, 22*b*) shrinks toward the center with the revolution of the orbiting scroll (22)**.

In the end plate **(21*a*) of the fixed scroll (21), a suction opening (21*c*) for low-level pressure refrigerant is formed at a peripheral edge of the compression chamber (25). On the other hand, in the end plate (22*a*) of the orbiting scroll (22), a discharge opening (22*c*) for high-level pressure refrigerant is formed centrally in the compression chamber (25). The suction pipe (14) secured firmly to the end plate (12) of the casing (10) is connected to the refrigerant suction opening (21*c*). Connected to the suction pipe (14)** is an evaporator of the refrigerant circuit (not shown).

A boss **(22*d*) to which an upper end part (33*a*) of the drive shaft (33) is connected is formed centrally in the lower surface of the end plate (22*a*) of the orbiting scroll (22). In the drive shaft (33), its upper end part (33*a*) is an eccentric shaft portion deviating from the rotational center of the drive shaft (33), and the drive shaft (33) is rotatably supported, at a position immediately below the eccentric shaft portion (33*a*), on the housing (23). In addition, a seal ring (26), disposed around the boss (22*d*), engages with an inner aperture (23*a*) of the housing (23), and it is arranged such that refrigerant gas at a high-level pressure introduced to the inner aperture (23***a*) will not leak to the outer peripheral side beyond the seal ring (26).

A discharge path (27), for guiding a high-level pressure refrigerant from the discharge opening (22*c*) of the orbiting scroll (22) to a space below the housing (23), is formed in the drive shaft (33). A lower end of the discharge path (27) opens at a position below the compressor motor (30). The high-level pressure refrigerant gas flowing out of the discharge path (27) is supplied from the discharge pipe (15) disposed in the trunk part (11) of the casing (10) to a condenser of the refrigerant circuit through a refrigerant pipe (not shown).

The drive shaft (33) is provided with a lubrication pump (28) and a lubrication path (33*b*). The lubrication pump (28) is disposed at a lower end part of the drive shaft (33) and is so constructed as to draw lubricant (not shown) stored at the bottom of the casing (10) with the revolution of the drive shaft (33). The lubrication path (33*b*) extends vertically in the inside of the drive shaft (33) and communicates with lubrication openings (not shown) formed at each part so that lubricant drawn by the lubrication pump (28) is supplied to each sliding part.

In the above-described arrangement, the rotor (32) starts rotating when the motor (30) is activated, and, as a result, the drive shaft (33) rotates. When the drive shaft (33) rotates, the orbiting scroll (22) does not rotate on its axis but executes only an orbital motion relative to the fixed scroll (21). As a result of this, with the variation in volume of the compression chamber (25), low-level pressure refrigerant is sucked in to a peripheral edge part of the compressor chamber (25) from the suction pipe (14). And the refrigerant is compressed. The refrigerant, which has now become high in pressure level, flows through the discharge path (27) and fills up a space below the housing (23) within the casing (10). After being discharged from the discharge pipe (15), the refrigerant is subjected to a condensation process, an expansion process, and an evaporation process in the refrigerant circuit and, thereafter, is again sucked in from the suction pipe (14) for compression, which is carried out repeatedly.

Figure 2:
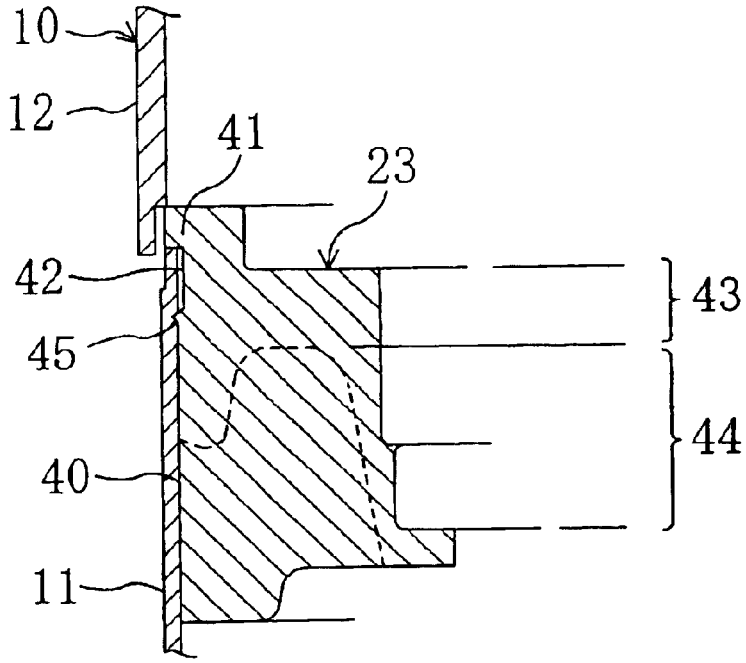
FIG. 2, which is a partially enlarged view of the scroll compressor of FIG. 1, illustrates a seal construction between a high-level pressure space and a low-level pressure space in the inside of a casing.
Figure 2:
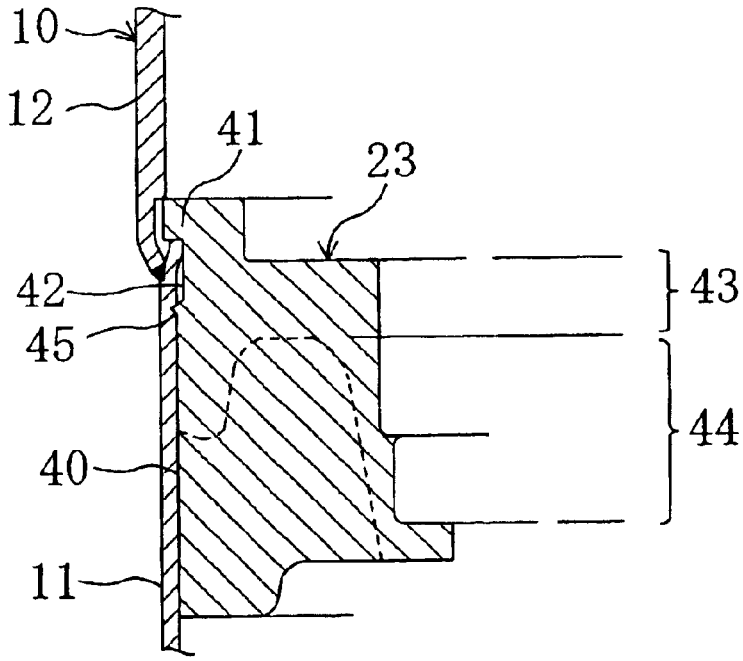
Figure 3:
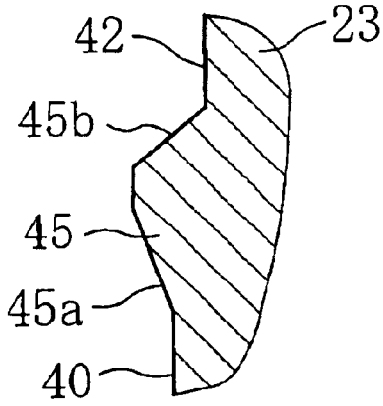
FIG. 3 is an enlarged view of a projection part of a housing.

As has been described above, the housing (23) vertically comparts the internal space of the casing (10). The first embodiment is characterized in that the housing (23) itself has a function of providing sealing between the low-level pressure space above the housing (23) and the high-level pressure space below the housing (23). Referring to FIGS. 2 and 3, such a seal construction will be described below.

FIG. 2, which is an enlarged cross-sectional view of the seal construction, shows that the housing (23) is dimension-structured such that an outer peripheral surface (40) of the housing (23) is secured firmly to the trunk part (11) of the casing (10) by press fitting. Formed at an upper end part of the housing (23) is a collar part (41) which projects radially outwardly so as to abut against an upper end surface of the trunk part (11). Additionally, formed in the outer peripheral surface (40) of the housing (23) is a peripheral groove (42) extending continuously in a circumferential direction for allowing for shrinkage of the casing (10) caused by welding at a weld area where the trunk part (11) and the end plate (12) are welded together. The peripheral groove (42) is formed at a position immediately below the collar part (41) in the outer peripheral surface (40) of the housing (23).

The housing (23) has a thick and thin parts (43) and (44) of different thicknesses relative to a radial direction. The thick part (43) is a thick part whose radial dimension is constant throughout. The thin part (44) is a part which partially includes at least a thin subpart.

The outer peripheral surface (40) of the housing (23) is provided, at a position in close proximity to the lower end of the peripheral groove (42), with a projection part (45) continuously extending in a circumferential direction, and the projection part (45) is located on the outer periphery of the thick part (43). The projection part (45) is so formed as to be press-fitted to the trunk part (11) of the casing (10), and, as shown in FIG. 3 which is an enlarged view of the projection part (45), its axial (upper and lower) ends (45*a*, 45*b*) are each formed into a tapered surface. Of these tapered surfaces of the projection part, the tapered surface (45*a*) on the press-fitting side (lower side) relative to the trunk part inclines at an angle of about 15 degrees with respect to the outer peripheral surface (40) of the housing (23). Additionally, the tapered surface (45*b*) on the side (upper side) opposite to the press-fitting side inclines at an angle of about 45 degrees with respect to the outer peripheral surface (40) of the housing (23).

The upper end plate (12) of the casing (10) is such formed that it abuts against the housing (23) in an axial direction and is clearance-fitted to the trunk part (11) and the housing (23) in a radial direction. In other words, the position of the end plate (12) is located axially with respect to the trunk part (11) and the housing (23), but is not located radially at this portion. Because of this, assembling work during welding of the trunk part (11) and the end plate (12) becomes easy to perform.

In the above-described seal construction, the housing (23) of the compression mechanism (20) is press-fitted to the trunk part (11) until the collar part (41) comes into abutment against the upper end surface of the trunk part (11), and, thereafter, the end plate (12) is welded to the trunk part (11), whereby the compression mechanism (20) is located securely within the casing (10) and the high-level pressure space and the low-level pressure space are sealed off from each other.

Stated another way, the housing (23) is press-fitted to the trunk part (11), as shown in FIG. 2(*a*). As a result, the outer peripheral surface (40) of the housing (23) comes into press contact with the inner peripheral surface of the trunk part (11) and the projection part (45) cuts into the inner peripheral surface of the trunk part (11). Thereafter, when, as shown in FIG. 2(*b*), the end plate (12) is welded to the trunk part (11), the trunk part (11) shrinks at the position of the peripheral groove (42) after welding (after cooling), and the trunk part (11) strongly tightens the housing (23) in a region at least from the peripheral groove (42) to the area immediately therebelow. This produces the same action as obtained by increasing the margin for press-fitting of the outer peripheral surface (40) and the projection part (45) of the housing (23) with respect to the trunk part (11), thereby providing enhanced seal effects. In addition to the arrangements that the housing (23) is merely press-fitted to the trunk part (11) and the projection part (45) cuts into to the trunk part (11), post-welding shrinkage of the trunk part (11) is utilized, thereby making it possible to enhance sealability to the same level as does thermal insert.

As stated above, the present embodiment provides the same sealability as thermal insert does. In the present embodiment, however, thermal insert is practically unnecessary. Moreover, since sealability is enhanced by making utilization of welding of the trunk part (11) and the end plate (12) which is an operation to be done inevitably for the compressor (1) of such a type, this eliminates the need for performing any other additional operations for seal function, and workability at assembling time is at the same level as when only press-fitting is carried out, and is excellently good.

In an arrangement that the trunk part (11) and the end plate (12) are welded together after thermal insert of the housing (23) to the trunk part (11), heating is carried out repeatedly thereby producing the possibility that component parts undergo distortion. By contrast to this, in the present invention heating is carried out only once. Therefore the possibility that component parts undergo distortion is slim.

Further, as a seal construction, a special seal member such as an O-ring has generally been used in the prior art. However, the first embodiment eliminates the need for the provision of a component part dedicated for sealing such as an O-ring. Therefore, the number of component parts for seal function will not increase and, therefore, the increase in costs will not occur.

Further, since one end of the projection part (45) on the forward side relative to the direction of press-fitting to the trunk part (11) is formed into the tapered surface (45*a*), this facilitates press-fitting of the housing (23) to the casing (10). Moreover, the other end of the projection part (45) on the rearward side relative to the press-fitting direction is formed into the tapered surface (45*b*) and, as a result of such arrangement, when the trunk part (11) shrinks along the tapered surface (45*b*) at a weld area where the trunk part (11) and the end plate (12) are welded together, such a shrinking area comes into press contact with the tapered surface (45*a*), thereby making it possible to provide sufficient sealability. In other words, insufficient press-contacting of this part with the tapered surface (45*a*) may cause a decrease in sealability. By contrast to this, in the present embodiment the shrinking area is brought into sufficient press contact with the tapered surface (45*a*) thereby improving sealability.

Additionally, in the present embodiment the projection part (45) is formed on the outer periphery of the thick part (43) of the housing (23) and, as a result of such arrangement, it becomes possible for the thick part (43) to sufficiently resist forces strongly tightening the housing (23) produced when the casing (10) shrinks by welding. Accordingly, even when the casing (10) shrinks, the housing (23) will undergo no deformation.

Further, in the present embodiment: the housing (23) to which the fixed scroll (21) is firmly secured is press-fitted to the trunk part (11); the projection part (45) is formed in the outer peripheral surface (40) of the housing (23); and the housing (23) is tightened by the trunk part (11) so that the high-level pressure space and the low-level pressure space are sealed off from each other, whereby tightening forces produced when the casing (10) shrinks will not act directly on the fixed scroll (21). Consequently, the wrap (21*b*) of the fixed scroll (21) will not deform and the decrement in performance of the compressor (1) due to refrigerant leakage or the like will not take place.

First Modification Example

Figure 4:
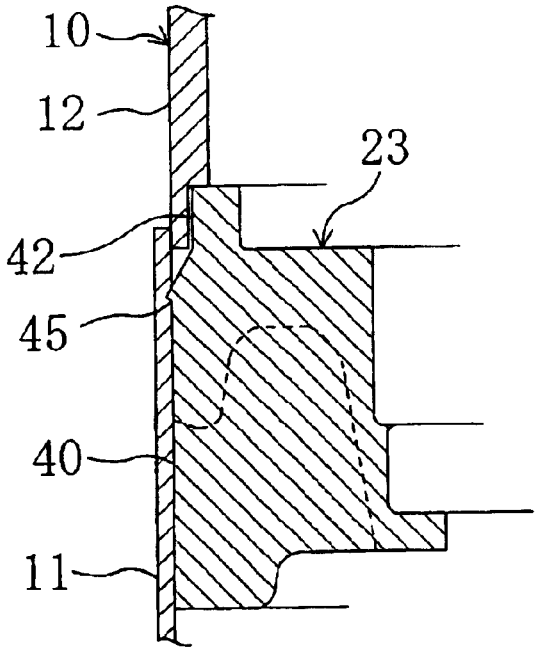
FIG. 4 is a view showing a modification example of a weld area where a trunk part and an end plate of the casing are welded together.

In the first embodiment the casing (10) is such constructed that the end plate (12) is engaged by clearance fitting with the trunk part (11) and the outer periphery of the housing (23). However, the end plate (12) may be formed so as to fit into the inner peripheral side of the trunk part (11) of the casing (10), and the peripheral groove (42) of the housing (23) may be formed such that it enables the end plate (12) to shrink by welding, as shown in FIG. 4. To sum up, the peripheral groove (42) of the housing (23) may receive any one of the trunk part (11) and the end plate (12) as long as the casing (10) is constructed so as to strongly tighten the housing (23) by allowing the casing (10) to shrink at a weld area where the trunk part (11) and the end plate (12) are welded together. Also in the arrangement described above, it is possible to provide the same effects as does the first embodiment.

Second Modification Example

The second modification example is a modification example of the projection part.

Figure 5:
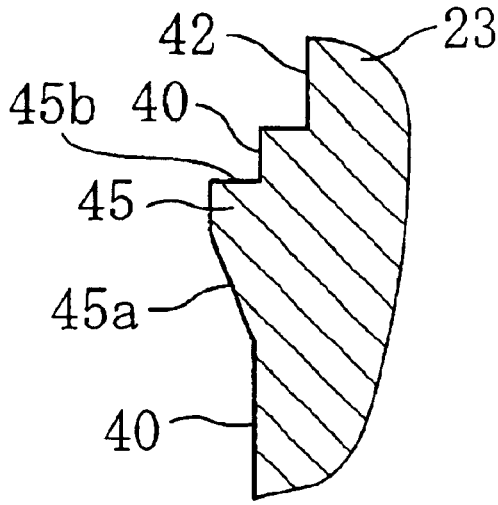
FIG. 5 depicts a first modification example of the projection part.
Figure 6:
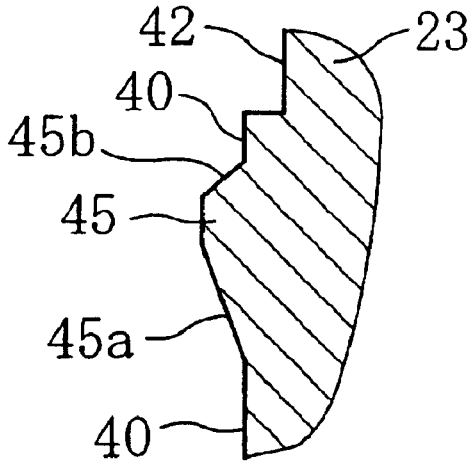
FIG. 6 depicts a second modification example of the projection part.
Figure 7:
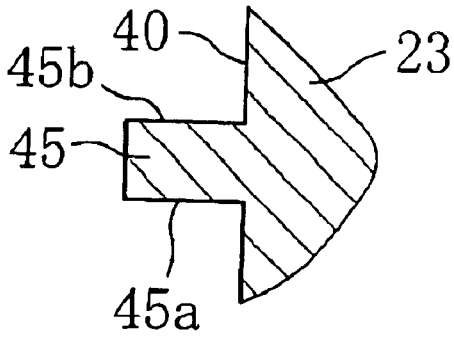
FIG. 7 depicts a third modification example of the projection part.

In an example shown in FIG. 5, only the lower end part (45*a*) of the projection part (45) which is a side to be press-fitted to the trunk part (11) is formed into a tapered surface, and the upper end part (45*b*) is formed into a shape which rises perpendicularly from the outer peripheral surface (40) of the housing (23). Additionally, by contrast to the first embodiment in which the upper end part (45*b*) of the projection part (45) is a tapered surface which connects directly to the peripheral groove (42), FIG. 6 shows an example in which only an area of the end part (45*b*) extending from the outer peripheral end of the projection part (45) to the outer peripheral surface (40) of the housing (23) is formed into a tapered surface. Besides, FIG. 7 illustrates an example in which neither the upper end part (45*b*) nor the lower end part (45*a*) of the projection part (45) is formed into a tapered surface. In the example the upper end part (45*b*) and the lower end part (45*a*) are end surfaces which rise perpendicularly from the outer peripheral surface (40) of the housing (23).

Even when the projection part (45) is formed in the way described above, the casing (10) strongly tightens the projection part (45) when the casing (10) shrinks after the trunk part (11) and the end plate (12) are welded together, thereby enhancing sealability more than conventional, substantially as in the above. In addition, it is possible to prevent the decrease in workability.

Figure 8:
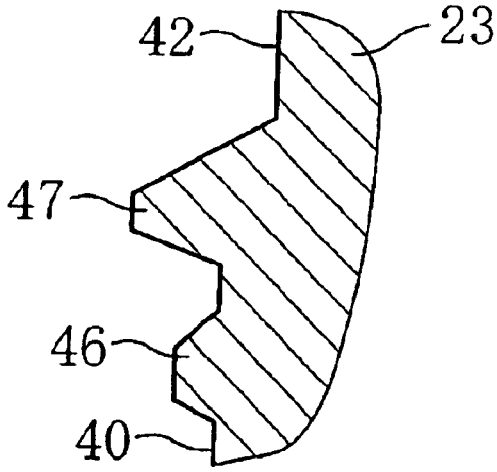
FIG. 8 depicts a fourth modification example of the projection part.

Further, FIG. 8 shows an example in which the projection part (46, 47) is provided at a plurality of areas of the outer peripheral surface (40) of the housing (23). The projection parts (46, 47) differ in projection height from each other. More specifically, the projection height of the projection part (46) on the press-fitting side (lower side) of the housing (23) to the trunk part (11) is made smaller, and the projection height of the projection part (47) on the rearward side (upper side) thereof is made greater.

In this example, the projection parts (46, 47) which extend continuously in a circumferential direction in the outer peripheral surface (40) of the housing (23) are arranged in multiple in the axial direction of the housing (23). As a result of such arrangement, the number of press-fitting points of the projection parts (46, 47) to the trunk part (11) increases thereby providing enhanced sealability Further, since the projection height of the projection part (46) on the press-fitting side of the housing (23) with respect to the trunk part (11) is made shorter, this makes it possible to press-fit the housing (23) to the casing (10) with relative ease while securing excellent sealability.

Second Embodiment

Figure 9:
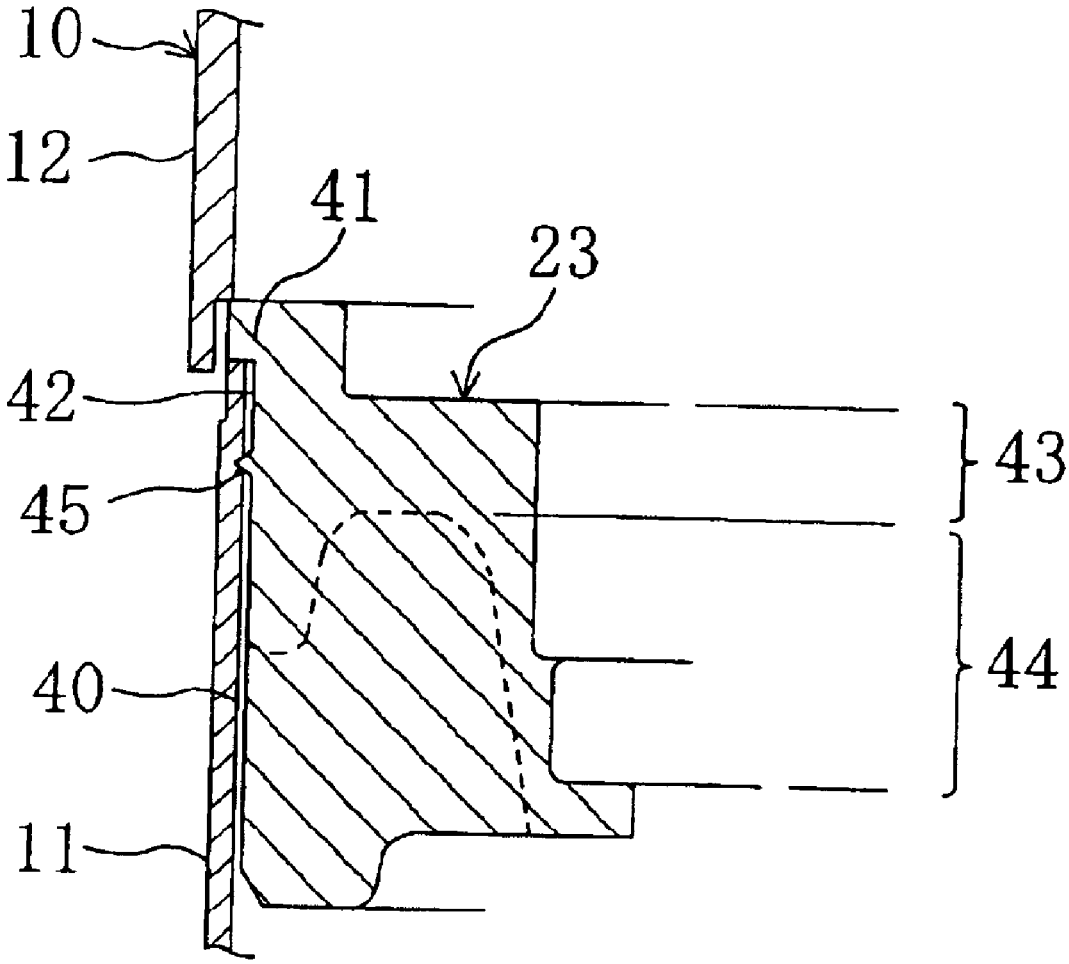
FIG. 9 is a partially enlarged view showing a seal construction of a scroll compressor according to a second embodiment of the present invention.
Figure 10:
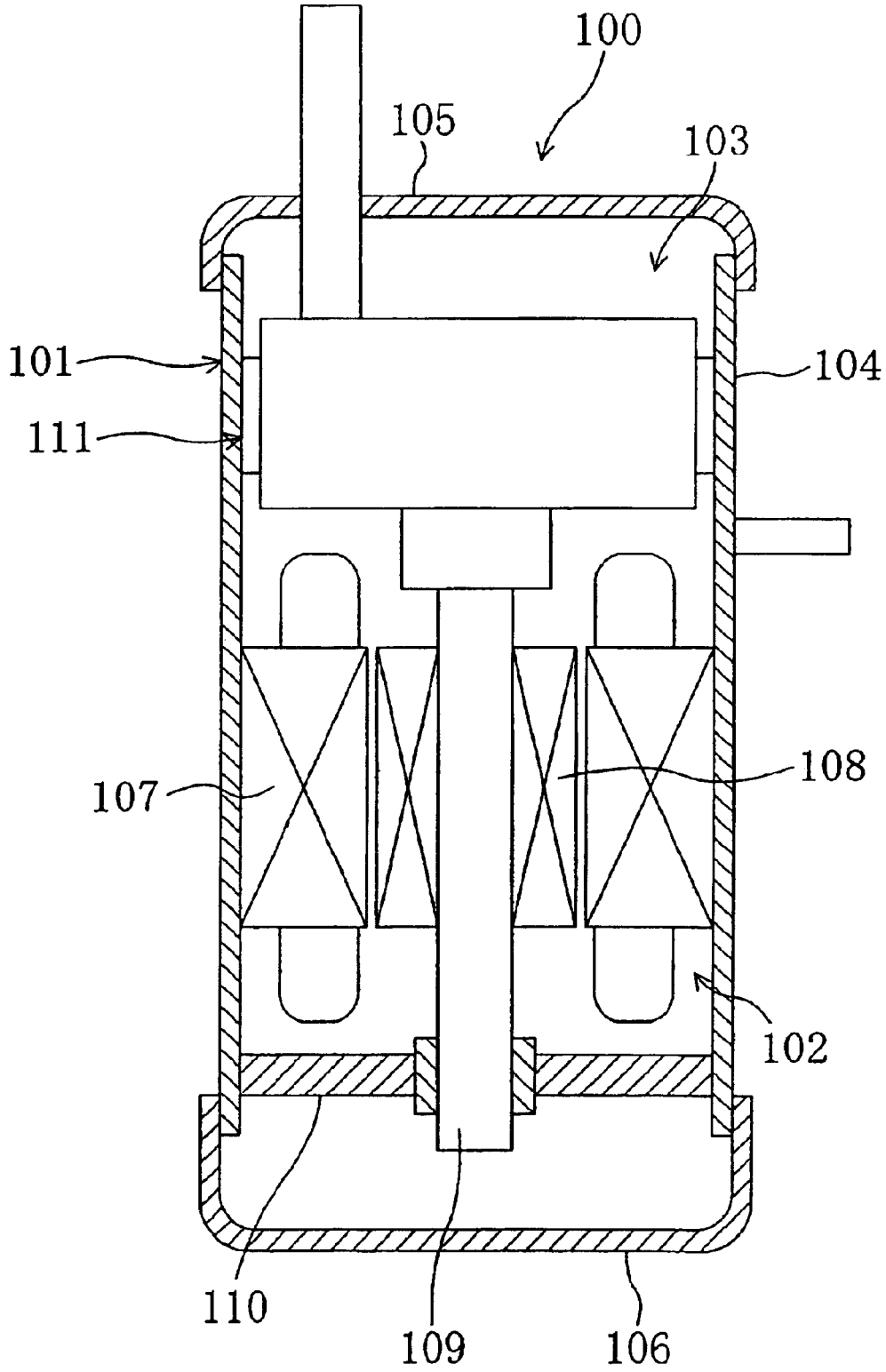
PRIOR ART FIG. 10
FIG. 10 is a view illustrating in cross section a conventional scroll compressor.

In the first embodiment it is arranged such that the outer peripheral surface (40) of the housing (23) is press-fitted to the trunk part (11) and, thereafter, the peripheral groove (42) and the projection part (45)(46, 47) are formed in the outer peripheral surface (40). On the other hand, in a second embodiment of the present invention the outer peripheral surface (40) of the housing (23) is clearance-fitted to the trunk part (11) of the casing (10), as shown in FIG. 9. It should be noted that the Figure illustrates such clearance-fitting in an exaggerated manner.

The second embodiment is the same as the first embodiment in the following points. That is to say, the peripheral groove (42) which continuously extends in a circumferential direction so as to allow for shrinkage of the casing (10) due to welding at a weld area where the trunk part (11) and the end plate (12) are welded together and the projection part (45) which continuously extends in a circumferential direction at a position in close proximity to the peripheral groove (42) are formed in the outer peripheral surface (40) of the housing (23), and the projection part (45) is so formed as to be press-fitted to the trunk part (11) of the casing (10). Further, other arrangements are the same as the first embodiment.

If, in the arrangement that the outer peripheral surface (40) of the housing (23) is clearance-fitted to the trunk part (11) or the end plate (12) of the casing (10), the peripheral groove (42) and the projection part (45) are formed in the outer peripheral part (45) of the housing (23), this makes it possible to perform press-fitting of the housing (23) to the trunk part (11) with more ease, therefore facilitating assembling work.

Additionally, the trunk part (11) and the end plate (12) are welded together, with the projection part (45) of the housing (23) press-fitted to the trunk part (11), thereby causing the casing (10) to shrink at the position of the peripheral groove (42). As a result, the tightening force of the casing (10) increases. Accordingly, also in this arrangement it is possible to provide sealability of the same level that thermal insert does.

Furthermore, in this arrangement the housing (23) is clearance-fitted to the casing (10), as a result of which the casing (10) strongly tightens only the projection part (45) and strong tightening forces will not act on the whole of the housing (23). Consequently, the housing (23) is unlikely to undergo deformation or the like.

It should be noted that, even in the second embodiment, the projection part (45)(46, 47) may be modified as shown in FIGS. 5–8.

Other Embodiments

The foregoing embodiments of the present invention may employ the following arrangements.

In the foregoing embodiments the examples in which the housing (23) serves as a partition member have been described. However, for example, it may be arranged such that the fixed scroll (21) is attached firmly, as a partition member, to the casing (10) to define a high-level pressure space and a low-level pressure space. In such a case, if a projection part is formed around a thick part (for example, the end plate (12)) of the fixed scroll (21), this prevents strong forces from acting on the wrap (21*b*). This avoids not only refrigerant leakage due to the deformation of the wrap (21*b*) but also performance decrement.

Further, in the foregoing embodiments the description has been made in terms of the examples in which the present invention is applied to the scroll compressor (1). However, the present invention is applicable to rotating compressors of the other type such as rotary compressors and swing compressors. Also in this case, it is advisable that a partition member for dividing the inside of the casing (10) into a high-level pressure space and a low-level pressure space is press-fitted to the casing (10) at a weld area where the trunk part (11) and the end plate (12) are welded together and the partition member is tightened strongly by making utilization of shrinkage of the casing (10) caused by welding.

Furthermore, in the foregoing embodiments the description has been made in terms of the examples in which the projection part (45)(46, 47) is formed in the outer peripheral surface (40) of the housing (23) which is press-fitted to the casing (10). However, in the arrangement that the outer peripheral surface (40) of the housing (23) is press-fitted to the casing (10), the projection part (45)(46, 47) is not necessarily formed. In other words, it may be arranged such that the housing (23) having, at the outer peripheral surface (40), no projection part is press-fitted to the trunk part (11) and tightening force resulting from post-welding shrinkage is utilized. Also in this case, assembling work is easy to carry out and, besides, the casing (10) strongly tightens the outer peripheral surface of the housing (23) because of its shrinkage caused by welding, thereby making it possible to further enhance sealability than conventional.

Further, in the foregoing embodiments the arrangement in which the housing (23) is press-fitted to the trunk part (11) of the casing (10) for firm attachment thereto has been descried. However, it may be arranged such that a partition member such as the housing (23) is secured firmly to the end plate (12) of the casing (10).

INDUSTRIAL APPLICABILITY

As has been described, the present invention is useful for rotating compressors.

What is claimed is:

1. A rotating compressor comprising:

a casing housing therein a compressor motor, a compression mechanism which is driven by said compressor motor, and a partition member which divides an inside of said casing into a high-level pressure space and a low-level pressure space, said casing having a trunk part shaped like a cylinder and an end plate secured firmly to said trunk part by welding, said partition member being so formed as to be press-fitted to said casing at one of a weld area where said trunk part and said end plate are welded together and a vicinity of said weld area and including a collar part projecting radially outwardly and contacting an upper end surface of said trunk part, said end plate contacting an upper end surface of said collar part and being so formed as to be clearance-fitted to said partition member and at least a part of said trunk part in a radial direction; and a peripheral groove extending continuously in a circumferential direction for allowing for shrinkage of said casing caused by welding at said weld area of said trunk part and said end plate and being formed in an outer peripheral surface of said partition member.

2. The rotating compressor of claim 1, further comprising at least one projection part that extends continuously in said circumferential direction at a position in proximity to said peripheral groove and is formed in said outer peripheral surface of said partition member, and said projection part is so formed as to be press-fitted to said casing.

3. A rotating compressor comprising:

a casing housing therein a compressor motor, a compression mechanism which is driven by said compressor motor, and a partition member which divides an inside of said casing into a high-level pressure space and a low-level pressure space, said casing having a trunk part shaped like a cylinder and an end plate secured firmly to said trunk part by welding, said partition member being so formed as to be clearance-fitted to said casing at one of a weld area where said trunk part and said end plate are welded together and a vicinity of said weld area and including a collar part projecting radially outwardly and contacting an upper end surface of said trunk part, said end plate contacting an upper end surface of said collar part and being so formed as to be clearance-fitted to said partition member and at least a part of said trunk part in a radial direction;

a peripheral groove extending continuously in a circumferential direction for allowing for shrinkage of said casing caused by welding at said weld area of said trunk part and said end plate and being formed in an outer peripheral surface of said partition member; and at least one projection part extending continuously in said circumferential direction at a position in proximity to said peripheral groove and being formed in said outer peripheral surface of said partition member, said projection part being so formed as to be press-fitted to said casing.

4. The rotating compressor of claim 2 or claim 3, wherein said at least one projection part of said partition member includes a plurality of projection parts provided at a plurality of areas.

5. The rotating compressor of claim 4, wherein said projection parts differ in projection height from each other.

6. The rotating compressor of claim 2 or claim 3, wherein at least one end of said projection part is formed into a tapered surface relative to an axial direction of said partition member.

7. The rotating compressor of claim 2 or claim 3, wherein said partition member has thick and thin parts of different thicknesses in said radial direction, and said projection part is formed on an outer periphery of said thick part.

8. The rotating compressor of any one of claims 1–3, wherein said compression mechanism is composed of a scroll type compression mechanism, and said partition member has a fixed scroll secured firmly to said partition member.

* * * * *

UNITED STATES PATENT AND TRADEMARK OFFICE

CERTIFICATE OF CORRECTION

PATENT NO. : 6,884,046 B2
DATED : April 26, 2005
INVENTOR(S) : Kazuhiko Matsukawa et al.

It is certified that error appears in the above-identified patent and that said Letters Patent is hereby corrected as shown below:

Title page,
Item [54], Title, "SCROLL COMPRESSOR" should be -- ROTATING COMPRESSOR --.
Item [73], Assignee, "Daiken Industries, Ltd." should be -- Daikin Industries, Ltd. --.
Item [22], PCT Filed, "Feb. 27, 2002" should be -- Feb. 27, 2003 --.

Signed and Sealed this

Fourth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,884,046 B2
DATED : April 26, 2005
INVENTOR(S) : Kazuhiko Matsukawa et al.

It is certified that error appears in the above-identified patent and that said Letters Patent is hereby corrected as shown below:

Title page,
Item [54], Title, should read -- ROTATING COMPRESSOR --.
Item [73], Assignee, should read -- Daikin Industries, Ltd. --.
Item [22], PCT Filed, should read -- Feb. 27, 2003 --.

Signed and Sealed this

Eleventh Day of April, 2006

JON W. DUDAS
*Director of the United States Patent and Trademark Office*